US005715606A

United States Patent [19]

de Wolf et al.

[11] Patent Number: 5,715,606

[45] Date of Patent: Feb. 10, 1998

[54] RAZOR BLADE

[76] Inventors: Arnold de Wolf, J.v. Woensel Kooylaan 19A, 1411 JX Naarden, Netherlands; Yigal Ringart, 13 Dan Street, Givat Ala, Israel, 10503

[21] Appl. No.: 697,619

[22] Filed: Aug. 28, 1996

[51] Int. Cl.[6] ..... B26B 21/54

[52] U.S. Cl. ..... 30/346.61; 30/48; 30/346.5

[58] Field of Search ..... 30/346.61, 346.58, 30/346.59, 346.5, 50, 48, 47

[56] References Cited

U.S. PATENT DOCUMENTS 2,033,725 3/1936 McWilliams ..... 30/346.61

2,336,048 12/1943 Testi ..... 30/346.61 X 4,932,122 6/1990 Shurland et al. ..... 30/346.5 X

*Primary Examiner*—Douglas D. Watts

*Attorney, Agent, or Firm*—Edwin D. Schindler

[57] ABSTRACT

Razor blades for use in shavers and especially in cartridge type razor blade units. Opposite the cutting edge of an essentially rectangular blade, and integral with this blade, there are provided one or more springy, resilient protrusions, in the plane of the blade. During shaving, these enable the blade, due to pressure exerted on the blade, to move a small distance towards the rear of the housing, thus increasing shaving comfort.

3 Claims, 2 Drawing Sheets

RAZOR BLADE

FIELD OF THE INVENTION

Razor blades for use as component in cartridge type razor blade units. They are characterized by having an essentially rectangular shape, one of the sides being the cutting edge, the opposite one being provided with one or more resilient protrusions in the plane of the blade. During shaving these allow a limited retraction of the blade in the housing, increasing shaving comfort.

BACKGROUND OF THE INVENTION

There are known various types of razor heads designed to move relative to razor handles as a result of the forces applied thereon while shaving. Such movable heads are part of the more expensive razors due to the complexity of their structure. Such razors are described amongst other in U.S. Pat. Nos. 4,281,456; 5,313,706; 5,074,042; 4,446,619; 4,443,939; 4,516,320 and others.

In the wet-shave razors the handle, and head are generally one unit, the blade cartridge another one. The integral unit does not enable a movement of the razor head relative to the face nor the movement of the blade relative to the razor cartridge head.

It is thus an object of the present invention to provide a razor blade adapted to move within the razor cartridge during shaving.

SUMMARY OF THE INVENTION

It is an object of the invention to provide simple and inexpensive blades for use in razors and especially in razor blade cartridges, which can also be used in disposable razor units.

There are provided novel razor blades of rectangular shape, one of the edges being the cutting edge, the opposite edge being provided with one or more cutouts defining protrusions in the plane of the blade, which allow a certain rearward movement of the blade in its housing during shaving, when a force is applied to the cutting edge. These springy members can have a wide variety of shapes as will be described, by way of example, in the following.

The invention is illustrated with reference to the schematic drawings, not according to scale, in which.

Figure 1:
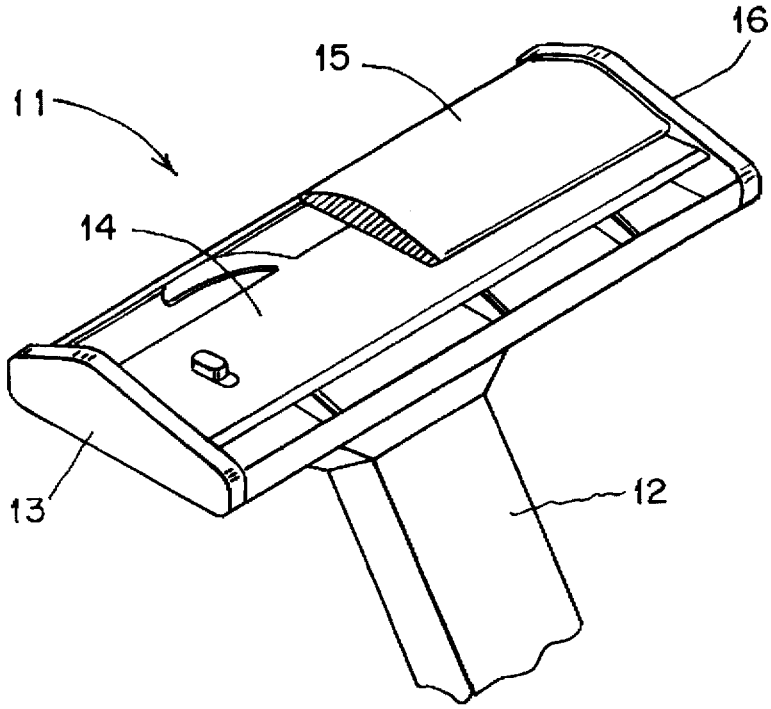
FIG. 1 is a perspective view, in partial section, illustrating a razor head.

As shown in FIG. 1 a razor 11 comprises a handle 12 and a head 13, within the head there being provided a blade 14 which has a cover.

Figure 2:
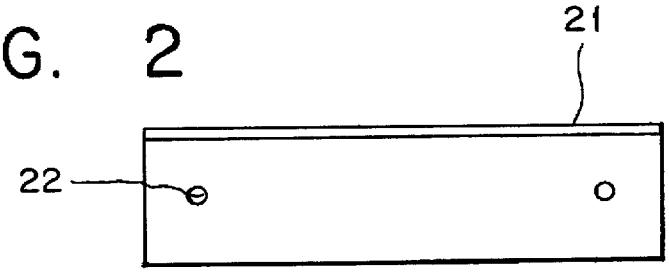
FIG. 2 illustrates a common conventional razor blade as used in cartridges.

As shown in FIG. 2 a conventional blade has a frontal cutting edge 21 and a plurality of apertures 22 adapted to secure the blade to its seat by pins or rivets.

Figure 3:
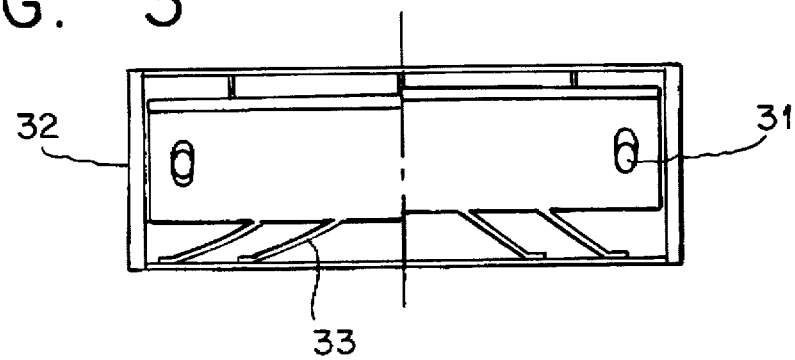
FIG. 3 illustrates a blade according to the invention.

FIG. 3 is a split illustration of a blade according to the invention, mounted in a razor cartridge from which the cap has been removed.

In blade, according to the invention are provided apertures 31 of longitudinal shape enabling the blade to move linearly within the razor cartridge 32 or the blade's housing. The right hand side of FIG. 3 illustrates the blade in its "normal" position while on the left hand side the blade it is in a position after some pressure has been applied on its cutting edge during shaving. At the opposite edge to the cutting edge there are provided "leg members" 33 which act as springs and when the pressure is removed the blade will revert to its initial position.

Figure 4:
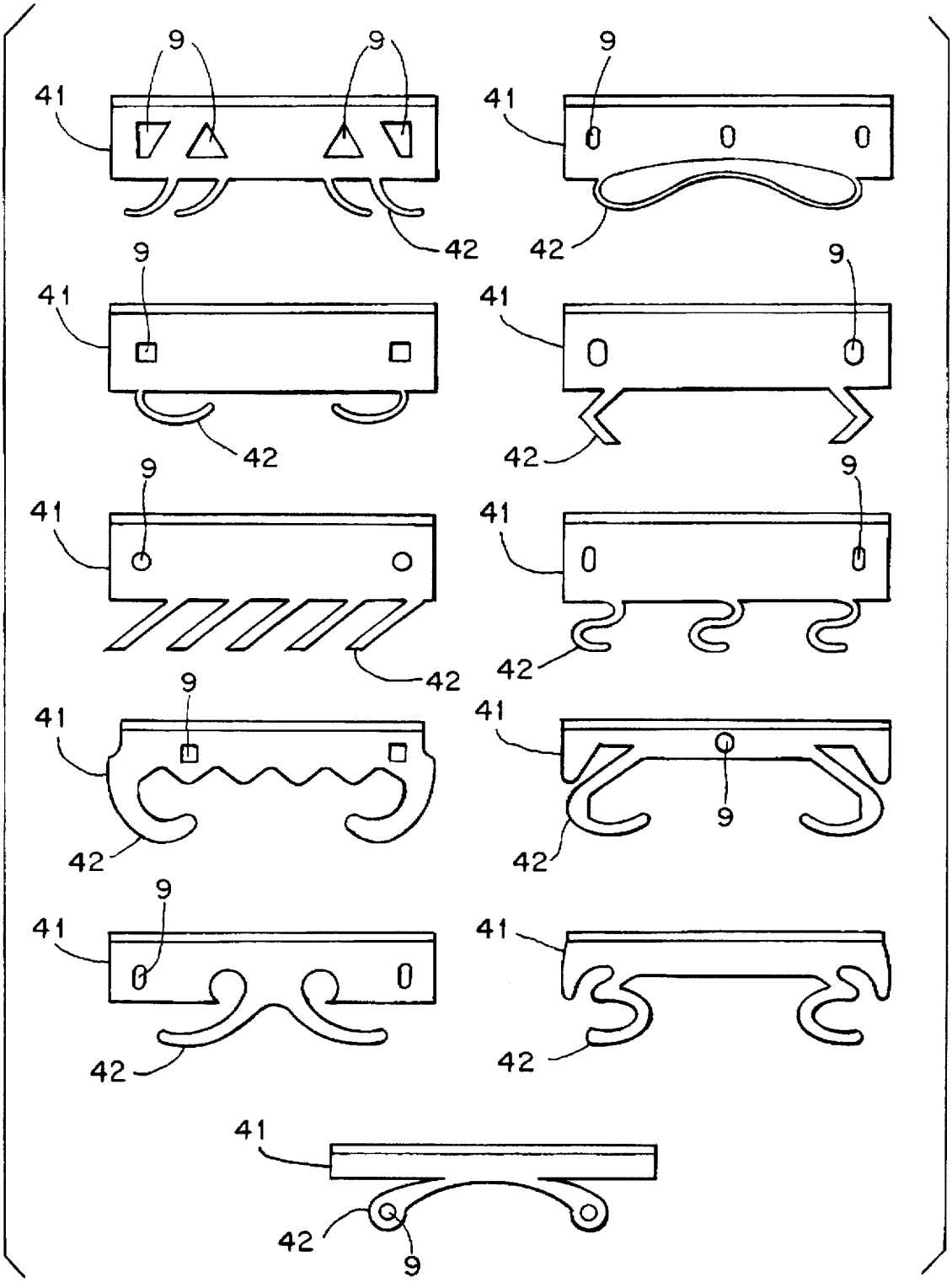
FIG. 4 illustrates different embodiments of blades according to the invention.

FIG. 4 illustrates several configurations of blades 41 according to the invention, with different cuts or cut-outs providing a variety of "leg members" 42 which function in the same manner.

The "leg members" i.e., the springy members, can differ in shape and size without departing from the scope of the invention. As can be seen these can be of straight, round or other configurations. The apertures 9 can be in different locations including locations within the springy members.

We claim:

1. A razor blade for use in a razor, particularly a razor having a cartridge for a disposable razor blade, said razor blade comprising:

a substantially rectangular shape with a first edge being a cutting edge and a second edge, being an edge opposite the first edge, having at least one integral springy member in a planar alignment with a flat surface of said razor blade for allowing a partial planar retraction of said razor blade within a housing of a razor when pressure is applied to the cutting edge of said razor blade during shaving.

2. The razor blade for use in a razor according to claim 1, wherein the flat surface of said razor blade includes at least one elongated aperture for allowing said razor blade to be secured within a housing of a razor having an abutment of a smaller diameter than said elongated aperture, the abutment being able to pass through said elongated aperture for said securement of said razor blade within the housing of the razor.

3. The razor blade for use in a razor according to claim 1, wherein said elongated aperture is in said at least one springy member.

* * * * *